US011813873B2

(12) United States Patent
Yamamoto et al.

(10) Patent No.: US 11,813,873 B2
(45) Date of Patent: Nov. 14, 2023

(54) LIQUID DISCHARGE HEAD AND METHOD FOR MANUFACTURING LIQUID DISCHARGE HEAD

(71) Applicant: BROTHER KOGYO KABUSHIKI KAISHA, Nagoya (JP)

(72) Inventors: Jiro Yamamoto, Nagoya (JP); Yasuhiro Sekiguchi, Nagoya (JP); Yoshitsugu Morita, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 84 days.

(21) Appl. No.: 17/489,504

(22) Filed: Sep. 29, 2021

(65) Prior Publication Data

US 2022/0126587 A1 Apr. 28, 2022

(30) Foreign Application Priority Data

Oct. 28, 2020 (JP) ..... 2020-180358

(51) Int. Cl.
*B41J 2/14* (2006.01)
*B41J 2/16* (2006.01)
*B41J 2/175* (2006.01)

(52) U.S. Cl.
CPC ..... *B41J 2/175* (2013.01); *B41J 2/1433* (2013.01); *B41J 2/162* (2013.01); *B41J 2/1623* (2013.01)

(58) Field of Classification Search
CPC ..... B41J 2/175; B41J 2/1433; B41J 2/162
See application file for complete search history.

(56) References Cited

U.S. PATENT DOCUMENTS

2005/0225608 A1 10/2005 To
2013/0155151 A1* 6/2013 Otaka ..... B41J 2/16 347/50
2020/0189273 A1* 6/2020 Hayashi ..... B41J 2/1433

FOREIGN PATENT DOCUMENTS

JP 2005-231314 A 9/2005
JP 2006-347036 A 12/2006

* cited by examiner

*Primary Examiner* — Jason S Uhlenhake
(74) *Attorney, Agent, or Firm* — Kenealy Vaidya LLP

(57) ABSTRACT

A liquid discharge head includes a channel unit. The channel unit is formed therein with: a plurality of individual channels aligning in a first direction, a common channel extending in the first direction, a supply hole in communication with the common channel, and a damper chamber provided in a position overlapping with the supply hole in a second direction orthogonal to the first direction. The channel unit includes a first plate having a first surface where a recess is formed to constitute the damper chamber, and a second plate having a second surface attached to the first surface via an adhesive. A protrusion is provided on a bottom of such a first part of the recess as overlaps with the supply hole in the second direction.

14 Claims, 9 Drawing Sheets

LIQUID DISCHARGE HEAD AND METHOD FOR MANUFACTURING LIQUID DISCHARGE HEAD

CROSS REFERENCE TO RELATED APPLICATIONS

The present application claims priority from Japanese Patent Application No. 2020-180358, filed on Oct. 28, 2020, the disclosure of which is incorporated herein by reference in its entirety.

BACKGROUND

Description of the Related Art

Conventionally, there are known ink jet heads (liquid discharge heads) where a damper chamber is provided in a position overlapping with an ink supply port (a supply hole). The ink supply port has a larger area than the other flow channel parts. Because the damper chamber is provided in that part of a large area, it is possible to obtain a high damper performance.

SUMMARY

In such an ink jet head as described above, the lower surface of a damper plate where a recess is formed to construct the damper chamber is attached to the upper surface of a spacer plate via an adhesive. For example, the adhesive applied to the outer circumference of an elastic roller and then the roller is pressed on the lower surface of the damper plate while the roller is rotated. By virtue of this, an adhesive applying process is carried out to apply the adhesive to the lower surface of the damper plate and, after the adhesive applying process, an attaching process is carried out to first stack the damper plate and the spacer plate and then attach the upper surface of the spacer plate to the lower surface of the damper plate via the adhesive.

Especially, if the damper chamber (the recess) is large in size, then in the adhesive applying process, the outer circumference of the roller may come into the recess to allow the adhesive to adhere to the bottom of the recess. In such a case, in the attaching process, the bottom surface of the damper chamber (recess) of the damper plate is attached to the upper surface of the spacer plate such that the damper chamber may be sized smaller than desired. Furthermore, because it is possible for the damper chamber to have a difference size from what is desired, it is not possible to obtain a stable damper performance.

Accordingly, an object of the present disclosure is to provide a liquid discharge head capable of obtaining a stable damper performance, and a method of manufacturing the same.

According to an aspect of the present disclosure, there is provided a liquid discharge head including a channel unit. The channel unit includes: a plurality of individual channels, a common channel, a supply hole, and a damper chamber. The plurality of individual channels are aligned in a first direction, each of the individual channels includes a nozzle. The common channel extends in the first direction and is connected to the plurality of individual channels. The supply hole is connected to the common channel. The damper chamber is located at a position overlapping with the supply hole in a second direction orthogonal to the first direction. The channel unit includes a first plate and a second plate. The first plate includes a first surface which is orthogonal to the second direction and on which a recess forming the damper chamber is formed. The second plate includes a second surface attached to the first surface via an adhesive. A protrusion is located at a bottom of a first part of the recess, the first part of the recess overlapping with the supply hole in the second direction.

DETAILED DESCRIPTION

In the following explanation, the direction Z is a vertical direction, the direction X and the direction Y are horizontal directions. The direction X and the direction Y are both orthogonal to the direction Z. The direction X is orthogonal to the direction Y. The direction Y corresponds to the "first direction" of the present disclosure, the direction Z corresponds to the "second direction" of the present disclosure, and the direction X corresponds to the "third direction" of the present disclosure.

First Embodiment

Figure 1:
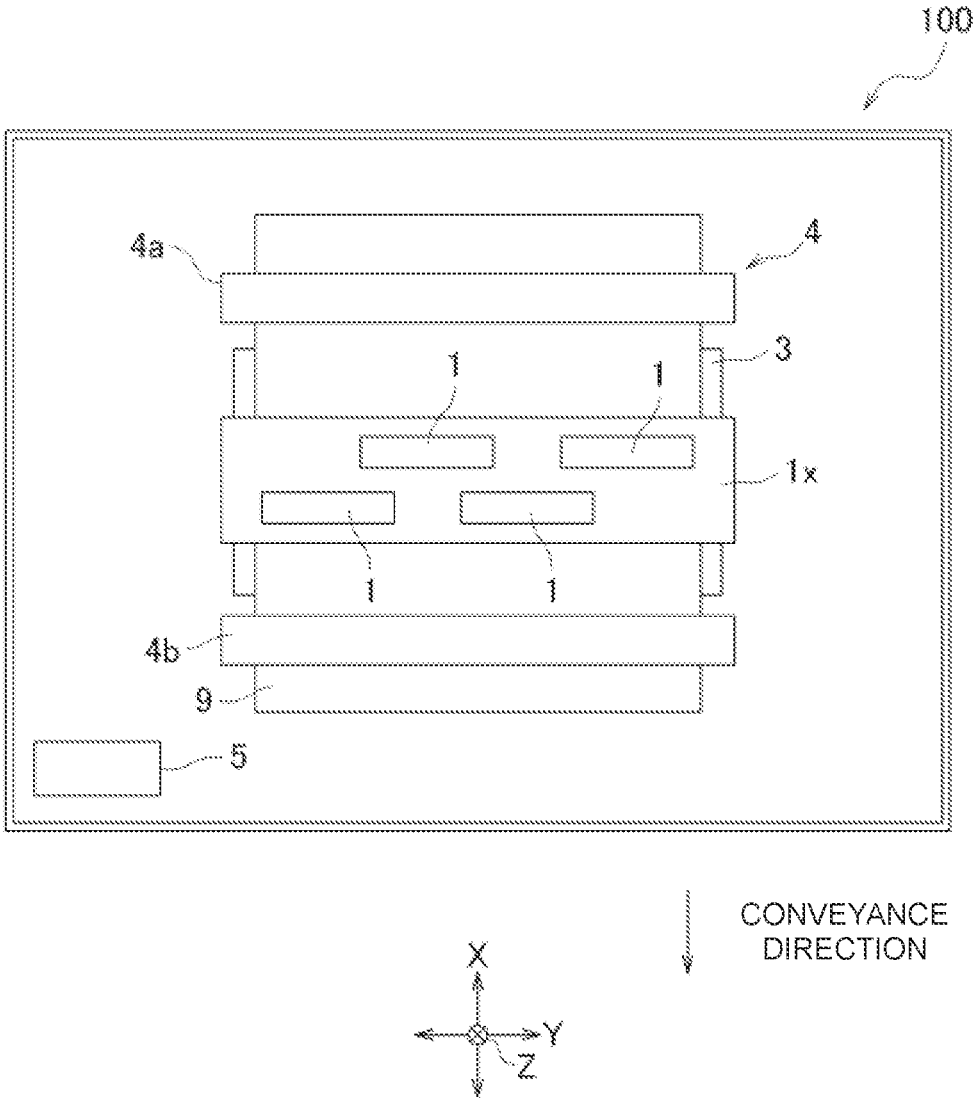
FIG. 1 is a plan view of a printer 100.

First, referring to FIG. 1, an explanation will be made on an overall configuration of a printer 100 including heads 1 according to a first embodiment of the present disclosure.

The printer 100 is provided with ahead unit 1*x* including four heads 1, a platen 3, a conveyer 4, and a controller 5.

Paper 9 is brought on the upper surface of the platen 3.

The conveyer 4 has two roller pairs 4*a* and 4*b* arranged to interpose the platen 3 in the direction X. If the controller 5 controls a conveyance motor (not depicted) to be driven, then the roller pairs 4*a* and 4*b* rotate with the paper 9 being nipped therebetween to convey the paper 9 along the direction X.

The head unit 1*x* is of a line type, being elongate in the direction Y to discharge ink onto the paper 9 from nozzles 35 (see FIGS. 2 to 5) with its position being fixed. The four heads 1 are elongate respectively in the direction Y and arrayed zigzag in the direction Y.

The controller 5 has a ROM (Read Only Memory), a RAM (Random Access Memory), and an ASIC (Application Specific Integrated Circuit). The ASIC carries out a recording process and the like based on programs stored in the ROM. In the recording process, the controller 5 records image on the paper 9 by controlling a driver IC of each head and the conveyance motor (all not depicted) on the basis of a recording command (including image data) inputted from an external device such as a PC or the like.

Next, referring to FIGS. 2 to 6, a configuration of the head 1 will be explained.

Figure 2:
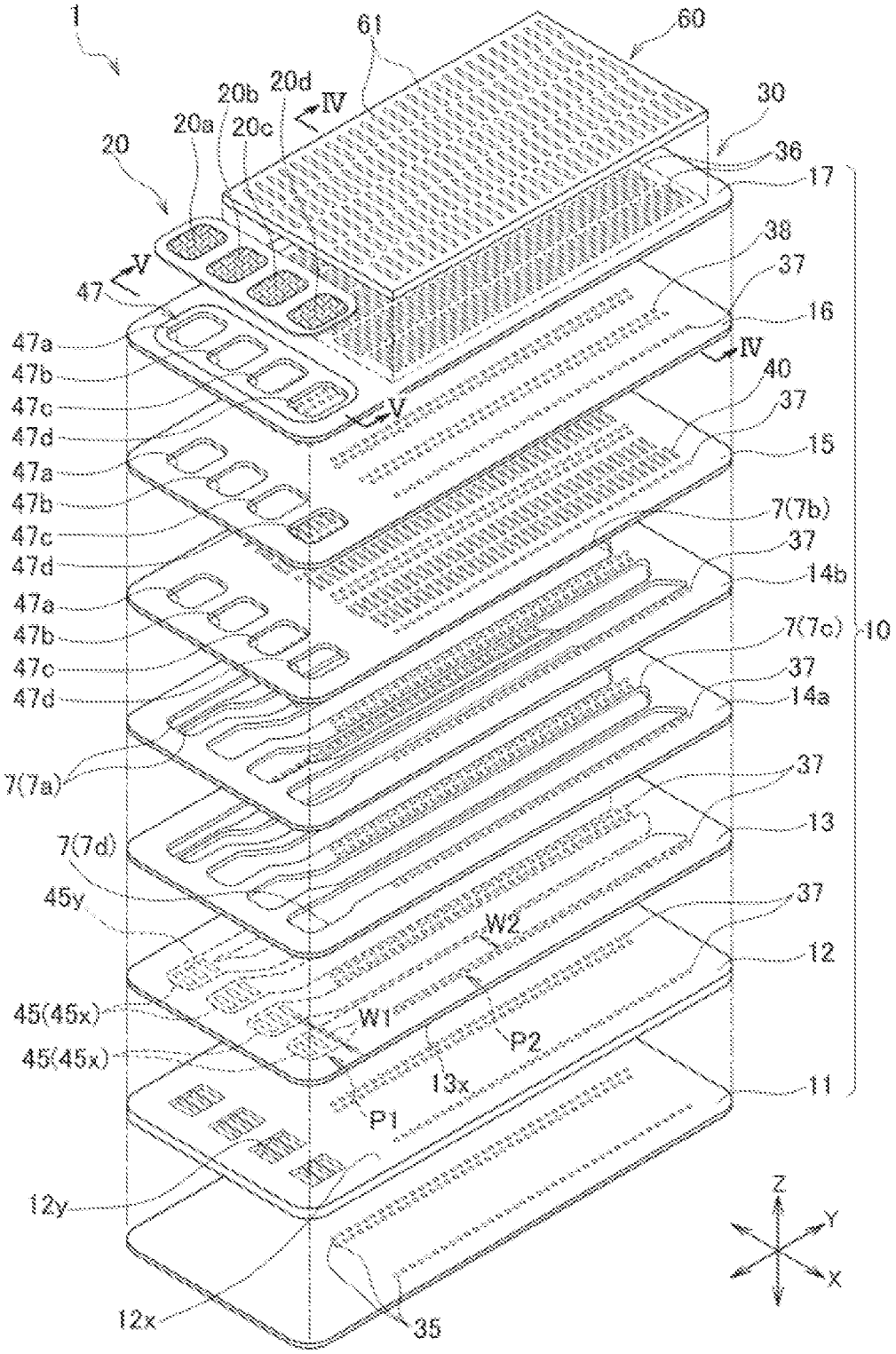
FIG. 2 is an exploded perspective view of the head 1.
Figure 3:
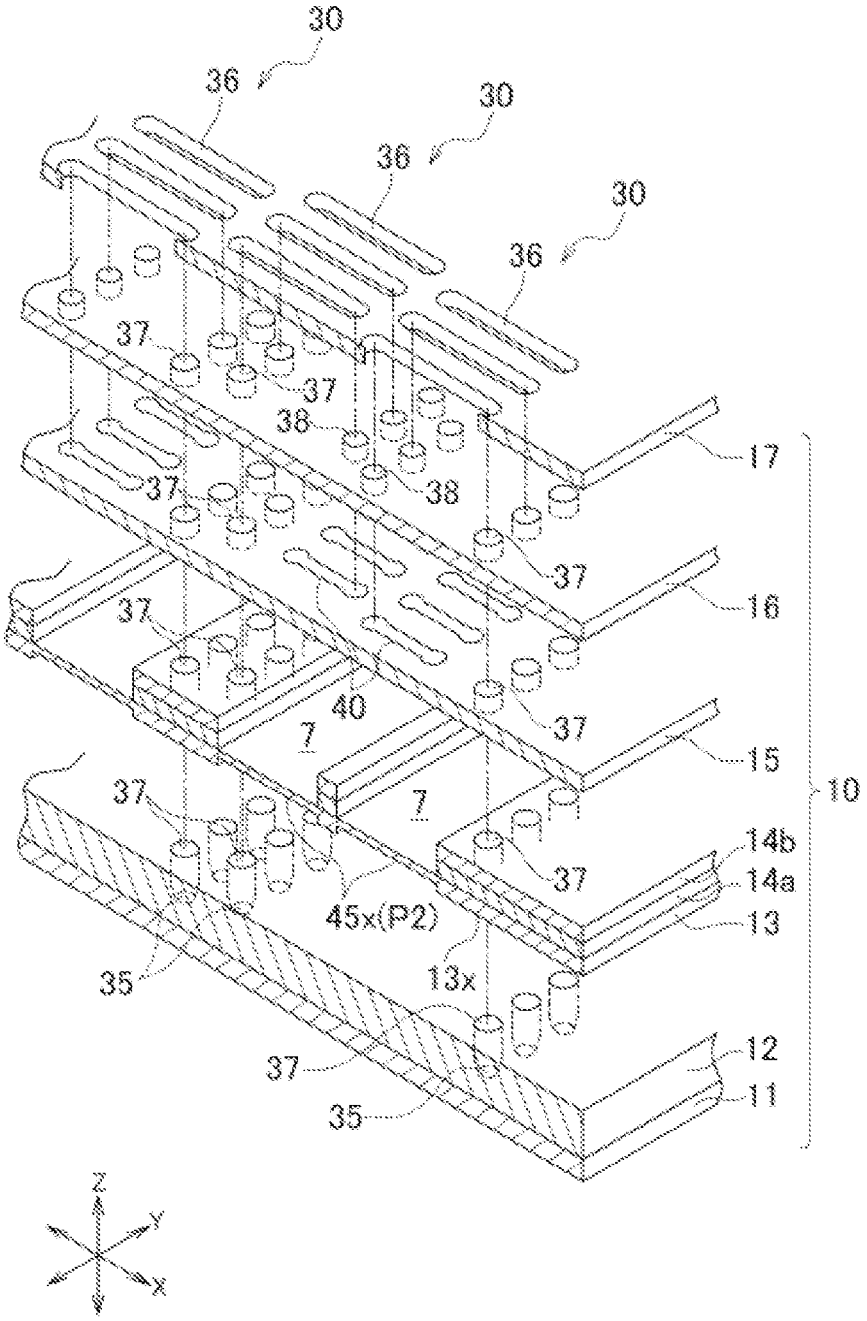
FIG. 3 is an enlarged exploded perspective view of the channel unit 10.
Figure 4:
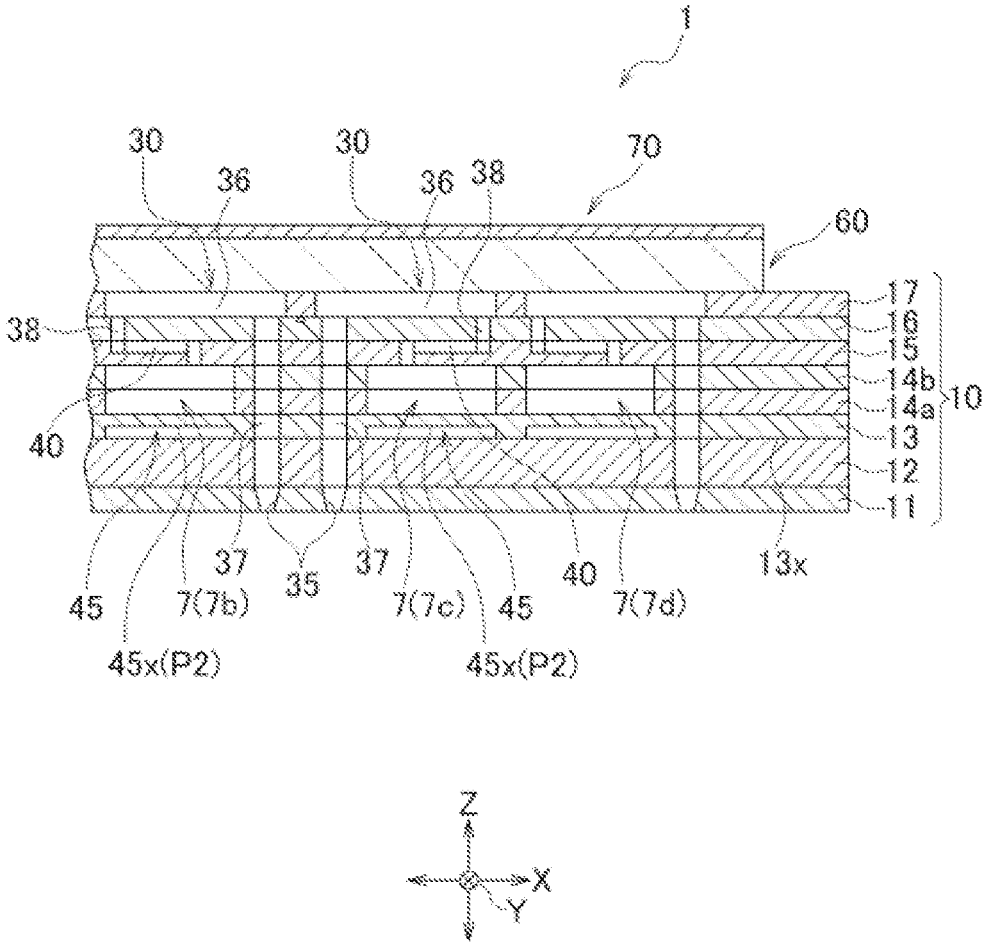
FIG. 4 is an enlarged cross section view of the head 1 along the line IV-IV of FIG. 2.

The head 1 has, as depicted in FIG. 2, a channel unit 10, a filter member 20, and an actuator member 60.

The channel unit 10 includes eight plates in total: a nozzle plate 11, a spacer plate 12, a damper plate 13, manifold plates 14*a* and 14*b*, spacer plates 15 and 16, and a cavity plate 17. Those eight plates are made of metal, resin, ceramic and the like, respectively, and stacked on and attached to each other via an adhesive in the direction Z. The damper plate 13 corresponds to the "first plate" of the present disclosure, and the spacer plate 12 corresponds to the "second plate" of the present disclosure.

In the nozzle plate 11, five nozzle arrays are formed. The five nozzle arrays align in the direction X. Each nozzle array includes a plurality of nozzles 35 aligning in the direction Y. The plurality of nozzles 35 are formed of a plurality of through holes arrayed zigzag in the direction Y.

In the cavity plate 17, five pressure chamber arrays are formed. The five pressure chamber arrays align in the direction X. Each pressure chamber array includes a plurality of pressure chambers 36 aligning in the direction Y. The plurality of pressure chambers 36 are formed of, in the same manner as the nozzles 35, a plurality of through holes arrayed zigzag in the direction Y.

The pressure chambers 36 are in respective communication with the nozzles 35 via through holes 37 formed through the spacer plates 15 and 16, the manifold plates 14*a* and 14*b*, the damper plate 13, and the spacer plate 12. Further, each pressure chamber 36 is in communication with one corresponding common channel 7 among five common channels 7 via a communication hole 38 formed in the spacer plate 16 and a connection flow channel 40 formed in the spacer plate 15 (see FIGS. 2 to 4).

In the channel unit 10, five individual channels are formed. The five individual channels align in the direction X. Each individual channel includes a plurality of individual channels 30 aligning in the direction Y. Each individual channel 30 is formed to reach to the nozzle 35 through the connection flow channel 40, the communication hole 38, the pressure chamber 36, and the through hole 37. In the same manner as the nozzles 35 and the pressure chambers 36, the plurality of individual channels 30 are arrayed zigzag in the direction Y.

In the manifold plates 14*a* and 14*b*, through holes are formed to construct the five common channels 7. The five common channels 7 extend respectively in the direction Y and align in the direction X. The five common channels 7 are in respective communication with the five individual channel arrays. Each common channel 7 is in communication with a plurality of individual channels 30 belonging to the corresponding individual channel array among the five individual channel arrays.

The upper surface of the damper plate 13 defines the bottom of the five common channels 7. In the lower surface 13*x* of the damper plate 13, a recess 45*x* is formed to define a damper chamber 45 (see FIGS. 2 to 4). Because the damper chamber 45 (the recess 45*x*) overlaps with the five common channels 7 in the direction Z, even if a pressure arises in the pressure chamber 36 and transmits to the common channel 7 in an ink discharge from the nozzle 35, the pressure is attenuated by an elastic deformation of the bottom (thin film) of the recess 45*x* in the damper plate 13. By virtue of this, it is possible to prevent the phenomenon of the pressure's transmission to another pressure chamber 36 (a so-called crosstalk).

A plurality of protrusions 45*y* are provided on the bottom of the recess 45*x* in the lower surface 13*x* (the first surface) of the damper plate 13. Further, a plurality of grooves 12*y* are provided in such a part of the upper surface 12*x* of the spacer plate 12 (the second surface) as overlaps in the direction Z with the respective protrusions 45*y*. Details of that will be explained later on.

As depicted in FIG. 2, at the ends of the cavity plate 17 and the spacer plates 15 and 16 on one side in the direction Y, four through holes are formed to construct the supply holes 47 respectively. The supply holes 47 align in the direction X. Each supply hole 47 is constructed from a supply hole 47*a* for supplying the black ink, a supply hole 47*b* for supplying the yellow ink, a supply hole 47*c* for supplying the magenta ink, and a supply hole 47*d* for supplying the cyan ink, in this order from the left according to FIG. 2.

The first and second two common channels 7*a* from the left in FIG. 2 are in communication with the supply hole 47*a*. The third common channel 7*b* from the left in FIG. 2 is in communication with the supply hole 47*b*. The fourth common channel 7*c* from the left in FIG. 2 is in communication with the supply hole 47*c*. The fifth common channel 7*d* from the left in FIG. 2 is in communication with the supply hole 47*d*. The supply holes 47*a*, 47*b*, 47*c* and 47*d* overlap respectively with the ends of the common channels 7*a*, 7*b*, 7*c* and 7*d* at one side in the direction Z.

Each of the supply holes 47*b*, 47*c*, and 47*d* where the color inks are supplied is in communication with one of the common channels 7*b*, 7*c*, and 7*d* whereas the supply holes 47*a* are in communication with the two common channels 7*a* where the black ink is supplied. This is because when the recording speed is raised to be higher in monochromatic recording than in color recording, it is considered that the black ink is consumed more in quantity per unit time than any color ink per unit time.

The filter member 20 is attached to the upper surface of the channel unit 10 (the upper surface of the cavity plate 17) via an adhesive to cover the four supply holes 47. The filter member 20 includes four filters 20*a*, 20*b*, 20*c*, and 20*d* overlapping respectively with the supply holes 47*a*, 47*b*, 47*c*, and 47*d* in the direction Z. The respective color inks supplied from an ink tank (not depicted) flow into the supply holes 47*a*, 47*b*, 47*c*, and 47*d* after foreign substances (dusts and the like) are removed in passing through the filters 20*a*, 20*b*, 20*c*, and 20*d*, to supply the common channels 7*a*, 7*b*. 7*c*, and 7*d*. In this manner, the filters 20*a*, 20*b*, 20*c*, and 20*d* constructing the inflow ports of the supply holes 47*a*, 47*b*, 47*c*, and 47*d* are provided at the upper side of the supply holes 47*a*, 47*b*, 47*c*, and 47*d* (at the other side than the damper chambers 45 in the direction Z).

The actuator member 60 is attached to such an area via an adhesive as without the filter member 20 being arranged on the upper surface of the channel unit 10 (the upper surface of the cavity plate 17). Detailed illustration being omitted, the actuator member 60 includes a vibration plate, a common electrode, a plurality of piezoelectric bodies, and a plurality of individual electrodes 61. The vibration plate and the common electrode are arranged on the upper surface of the channel unit 10 (the upper surface of the cavity plate 17), to cover all pressure chambers 36 formed in the cavity plate 17. On the other hand, the piezoelectric bodies and the individual electrodes 61 are provided according to each pressure chamber 36 to overlap respectively with the pressure chambers 36 in the direction Z.

A wiring member 70 (see FIG. 4) is arranged on the upper surface of the actuator member 60. The wiring member 70 has wires connected electrically with the respective individual electrodes 61 and the common electrode.

The controller 5 (see FIG. 1) controls a driver IC mounted on the wiring member 70 to maintain the potential of the common electrode at the ground potential and to change the potential of the individual electrodes 61 between a driver potential and the ground potential. On this occasion, in the vibration plate and the piezoelectric bodies, the parts interposed between the individual electrodes 61 and the pressure chambers 36 deform to project toward the pressure chambers 36. By virtue of this, the pressure chambers 3 change in volume such that a pressure is applied to the inks in the pressure chambers 36 to discharge the inks from the nozzles 35.

Next, referring to FIGS. 2, 5 and 6, an explanation will be made on the recess 45*x* and the protrusions 45*y* provided in the lower surface 13*x* of the damper plate 13, and the grooves 12*y* provided in the upper surface 12*x* of the spacer plate 12.

The recess 45*x* can be formed by way of half-etching the lower surface 13*x* of the damper plate 13. The protrusions 45*y* are formed without etching the parts corresponding to the protrusions 45*y* during that half etching. The grooves 12*y* can be formed by way of half-etching the upper surface 12*x* of the spacer plate 12.

As depicted in FIG. 2, the recesses 45*x* include four first parts P1 overlapping respectively with the four supply holes 47 in the direction Z, and five second parts P2 overlapping respectively with the five common channels 7 but not overlapping with the supply holes 47 in the direction Z. A width W1 of each first part P1 (the length in the direction X) is larger than a width W2 of each second part P2 (the length in the direction X).

The protrusions 45*y* are provided in the first parts P1. In particular, each of the four first parts P1 is provided with three protrusions 45*y*. The three protrusions 45*y* are all rectangular and elongate in the direction X on a plane orthogonal to the direction Z, and aligned in the direction Y.

An interval S1 (see FIG. 6) in the direction X between each protrusion 45*y* and either side wall of the recess 45*x* (the first part P1) is 1 mm or less. Each protrusion 45*y* is arranged at the center of the recess 45*x* (the first part P1) in the direction X for the interval S1 to be constant.

An interval S2 (see FIG. 6) in the direction Y between the protrusion 45*y* closest to one end of the recess 45*x* (the first part P1) in the direction Y among the three protrusions 45*y*, and the side wall of the recess 45*x* (the first part P1) is 1 mm or less. An interval S3 in the direction Y between one and another of the three protrusions 45*y* is also 1 mm or less. The three protrusions 45*y* are arranged at the same intervals S2 and S3 from one end of the recess 45*x* (the first part P1) in the direction Y.

The groove 12*y* is provided to correspond to each protrusion 45*y* to overlap in the direction Z with each protrusion 45*y*. The groove 12*y* is rectangular and elongate in the direction X on a plane orthogonal to the direction Z just as with the protrusion 45*y*. The groove 12*y* is sized larger than the protrusion 45*y* but smaller than the recess 45*x* (the first part P1). That is, the groove 12*y* includes a part overlapping in the direction Z with the protrusion 45*y* and a part overlapping in the direction Z with the other part than the protrusion 45*y* on the bottom of the recess 45*x* (the first part P1).

Figure 5:
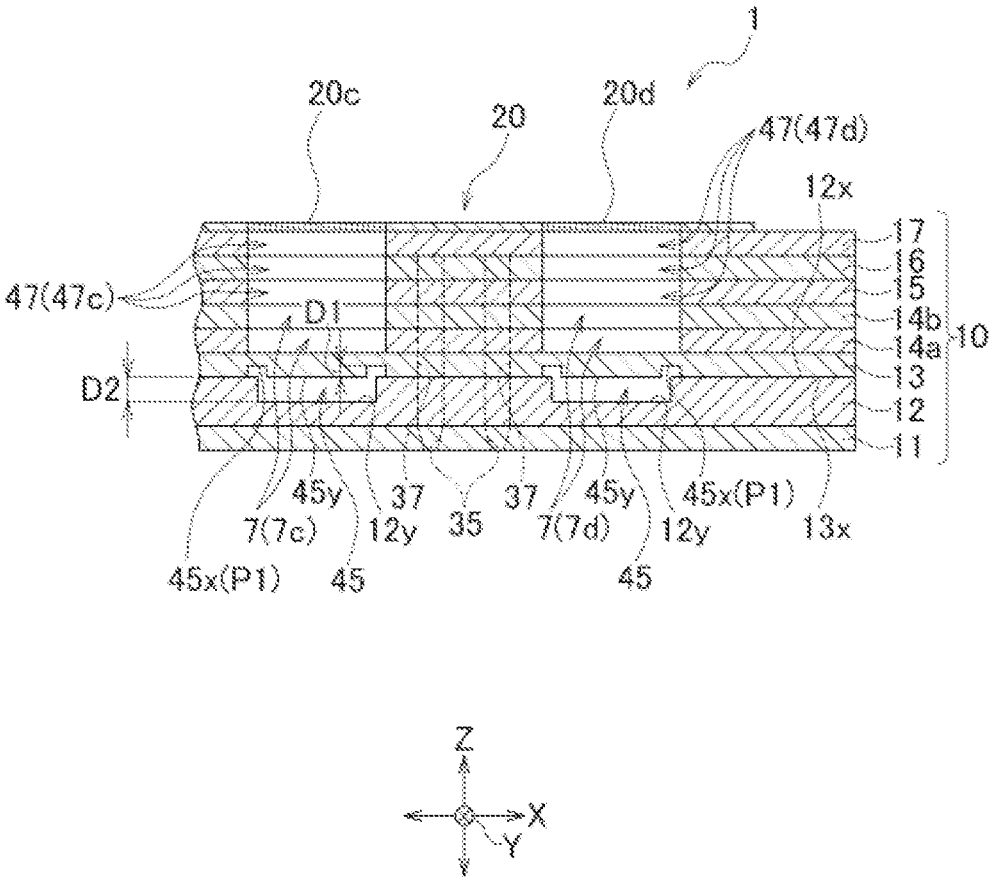
FIG. 5 is an enlarged cross section view of the head 1 along the line V-V of FIG. 2.

As depicted in FIG. 5, the spacer plate 12 is thicker than the damper plate 13 in the direction Z (for example, the spacer plate 12 is 100 μm thick whereas the damper plate 13 is 50 μm thick). The recess 45*x* and the grooves 12*y* are each as deep as almost half of the thickness of the plates 12 and 13, respectively. That is, a depth D2 of the groove 12*y* in the direction Z is larger than a depth D1 of the recess 45*x* in the direction Z. The protrusion 45*y* is as high as the depth D1 of the recess 45*x*.

Next, referring to FIGS. 7A and 7B, an explanation will be made on a process of attaching the damper plate 13 and the spacer plate 12.

Figure 7A:
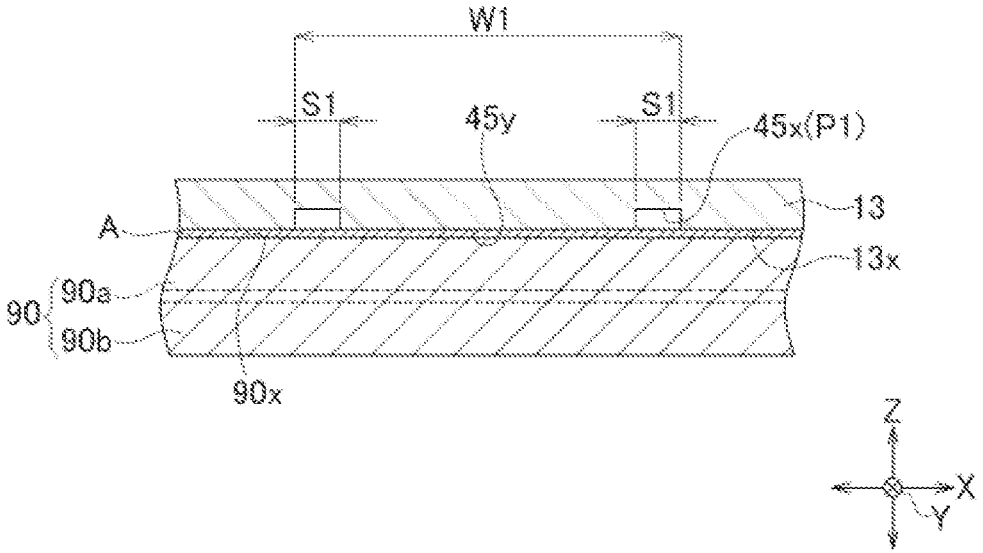
FIG. 7A is a cross section view along the line VII-VII of FIG. 6, depicting an adhesive applying process.

In this process, a roller 90 depicted in FIG. 7A is used. The roller 90 includes a shaft 90*a*, and a peripheral part 90*b* arranged about the shaft 90*a*. The peripheral part 90*b* is an elastic member made of urethane (at a density of $1.92\times10^{-7}$ kg/mm$^3$, for example) or the like.

First, as depicted in FIG. 7A, an adhesive A is applied to a peripheral surface 90*x* of the peripheral part 90*b* which is rotated about the shaft 90*a* along the direction X while the peripheral surface 90*x* is pressed on the lower surface 13*x* of the damper plate 13. In this manner, the adhesive A is applied to the lower surface 13*x* (the adhesive applying process). On this occasion, the pressing force is, for example, 500 kPa. Further, the roller 9X) is moved at this time in a transference direction T along the direction Y with respect to the lower surface 13*x* (see FIG. 6). The transference direction T is orthogonal to a direction in which the protrusions 45*y* extend (the direction X) on a plane orthogonal to the direction Z.

Because of its elasticity, the peripheral part 90*b* may deform when pressed by the lower surface 13*x* in the adhesive applying process, to enter the inside of the recess 45*x* (the first part P1). For example, if the protrusions 45*y* are not provided on the bottom of the recess 45*x* (the first part P1), then the peripheral part 90*b* enters the inside of the recess 45*x* (the first part P1) such that the adhesive A is more likely to attach to the bottom of the recess 45*x* (the first part P1). However, in the first embodiment, the protrusions 45*y* are provided on the bottom of the recess 45*x* (the first part P1), and the interval S1 is narrowed (S1<W1). By virtue of this, the adhesive A is less likely to attach to the bottom of the recess 45*x* (the first part P1). On the other hand, because the leading end surfaces of the protrusions 45*y* are positioned below the bottom of the recess 45*x* (the first part P1) (at the same level as the lower surface 13*x* in the first embodiment), the adhesive A applied to the peripheral surface 90*x* attaches thereto (see FIG. 7B).

Figure 7B:
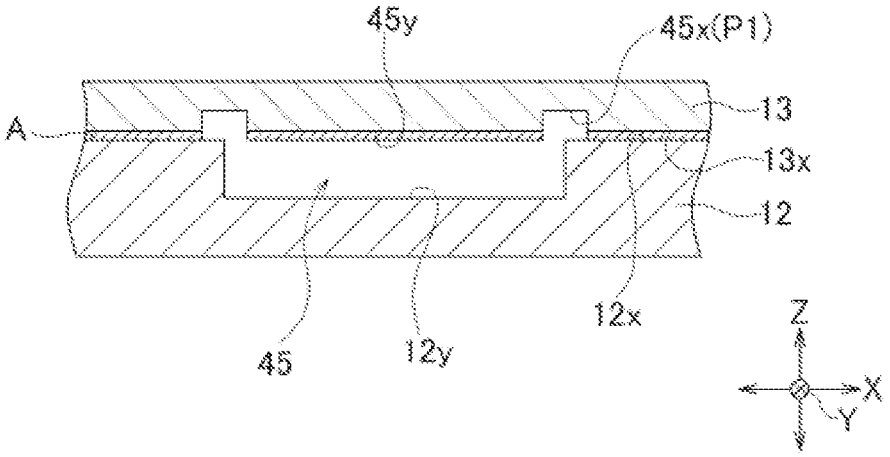
FIG. 7B is a cross section view along the line VII-VII of FIG. 6, depicting an attaching process.

Next, after the adhesive applying process depicted in FIG. 7A, as depicted in FIG. 7B, the damper plate 13 and the spacer plate 12 are stacked together such that the upper surface 12*x* of the spacer plate 12 is attached to the lower surface 13*x* of the damper plate 13 via the adhesive A (the attaching process). On this occasion, between the damper plate 13 and the spacer plate 12, the damper chamber 45 is formed. Especially, in the part of overlapping with the supply hole 47 in the direction Z (see FIG. 2), because the groove 12*y* is provided in the upper surface 12*x* of the spacer plate 12, the protrusion 45*y* is not attached to the upper surface 12*x* such that the damper chamber 45 is formed to include the space between the protrusion 45*y* and the groove 12*y*.

Note that as in the first embodiment, the configuration of not attaching the protrusion 45*y* to the upper surface 12*x* is applicable to the case of, for example, the ink viscosity being 2 to 5 cps, and the drive frequency being 25 to 30 kHz.

As described above, according to the first embodiment, the protrusion 45*y* is provided on the bottom of the recess 45*x* (the first part P1) constituting the damper chamber 45. In this case, in the adhesive applying process (FIG. 7A), the adhesive A is more likely to attach to the leading end surface of the protrusion 45*y*. Further, the adhesive A is less likely to attach to the other parts than the protrusion 45*y* on the bottom of the recess 45*x* (the first part P1). By virtue of this, it is possible to prevent the problem that the adhesive A attaches to some unexpected parts such that the damper chamber cannot be formed in a desired size. That is, by intensively providing the protrusion 45*y* to which the adhesive A is more likely attach, the adhesive A is thus prevented from being attached to the other parts than the protrusion 45*y* in the bottom of the recess 45*x* (the first part P1). By virtue of this, it is possible to form the damper chamber 45 in a desired size, thereby allowing for obtaining a stable damper performance.

As depicted in FIG. 2, the recess 45*x* includes the first part P1 overlapping with the supply hole 47 in the direction Z, and the second part P2 not overlapping with the supply hole 47 but overlapping with the common channel 7 in the direction Z. The width W1 (the length in the direction X) of the first part P1 is larger than the width W2 (the length in the direction X) of the second part P2. Consider that the protrusions 45*y* are not provided on the bottom of the recess 45*x* (the first part P1). In such a case, in the adhesive applying process (FIG. 7A), when the roller 90 is moved in the direction Y, the peripheral part 90*b* of the roller 90 is more likely to enter the inside of the recess 45*x* (the first part P1). Then, this is more likely to give rise especially to a problem that the adhesive A attaches to the bottom of the recess 45*x* (the first part P1). In the first embodiment, however, in the case of the width W1 being comparative large in such fashion, by providing the protrusions 45*y* on the bottom of the recess 45*x* (the first part P1) to narrow the interval S1 (S1<W1). By virtue of this, the adhesive A is made less likely to attach to the bottom of the recess 45*x* (the first part P1), thereby preventing the above problem from arising.

At the upper side of the supply hole 47 (the other side than the damper chamber 45 in the direction Z), an inflow port of the supply hole 47 (filters 20*a*, 20*b*, 20*c*, and 20*d*) are provided (see FIGS. 2 and 5). In this context, with the ink flowing in from the inflow port, a high pressure arises in the supply hole 47. However, the damper chamber 45 attenuates that pressure to allow for prevention of undesirable influence on liquid discharges. Further, with the damper chamber 45 which is necessary for attenuating the high pressure in this manner, a stable damper performance is obtainable such that it is possible to realize a high flow amount of the liquid discharges.

The grooves 12*y* are provided in the part of the upper surface 12*x* of the spacer plate 12 overlapping in the direction Z with the protrusions 45*y* (see FIG. 5). In this context, in the attaching process (FIG. 7B), it is possible to let the protrusions 45*y* not attach to the spacer plate 12. By virtue of this, it is possible to secure the size of the damper chamber 45 with the recess 45*x* including the protrusions 45*y* as a whole, thereby allowing a high damper performance to be obtained.

The depth D2 of the groove 12*y* in the direction Z is larger than the depth D1 of the recess 45*x* in the direction Z (see FIG. 5). In this context, in the attaching process (FIG. 7B), even if the plates 12 and 13 bend to deform, it is still possible to let the protrusions 45*y* not attach to the spacer plate 12. By virtue of this, it is possible to secure more reliably the size of the damper chamber 45 with the recess 45*x* including the protrusions 45*y* as a whole, thereby allowing a high damper performance to be obtained.

The spacer plate 12 is thicker than the damper plate 13 in the direction Z (see FIG. 5). In this context, it is possible to reliably realize a deep structure of the grooves 12*y* as described above.

Figure 6:
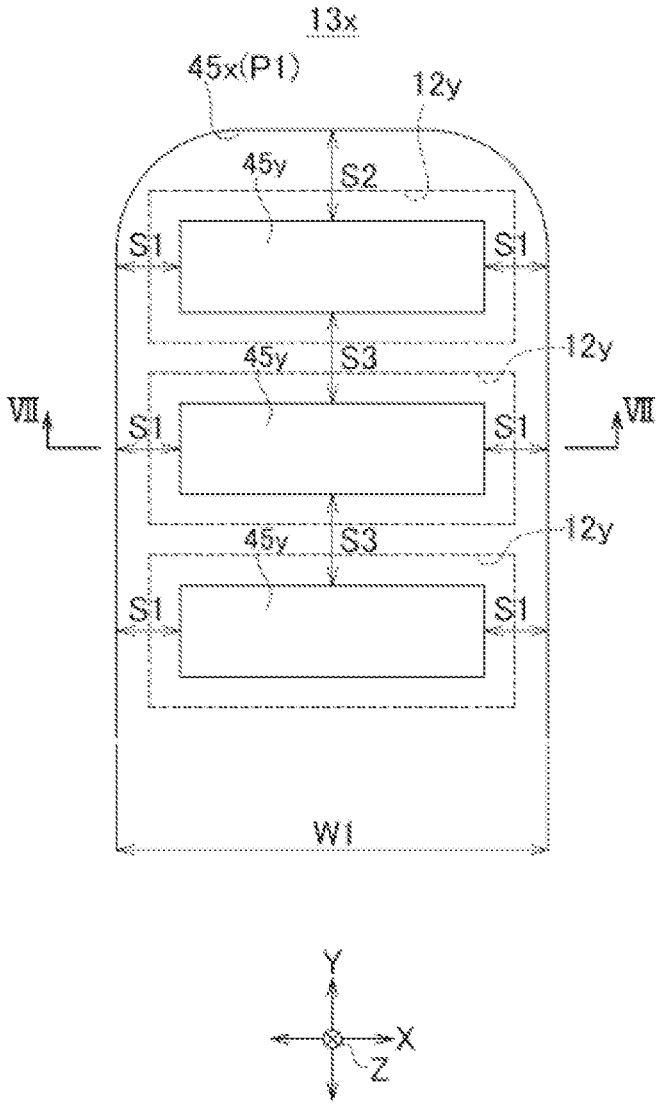
FIG. 6 is a plan view depicting a recess 45*x* and protrusions 45*y* provided in a lower surface 13*x* of a damper plate, and grooves 12*y* provided in an upper surface of a spacer plate.

The groove 12*y* includes a part overlapping with the protrusion 45*y* in the direction Z, and a part overlapping in the direction Z with the other part of the bottom of the recess 45*x* (the first part P1) than the protrusion 45*y* (see FIG. 6). In this context, in the attaching process (FIG. 7B), even if a positional deviation arises between the plates 12 and 13, it is still possible to let the protrusions 45*y* not attach to the spacer plate 12. By virtue of this, it is possible to secure reliably the size of the damper chamber 45 with the recess 45*x* including the protrusions 45*y* as a whole, thereby allowing a high damper performance to be obtained.

A plurality of protrusions 45*y* are provided on the bottom of a recess 45*x* (see FIG. 6). In this context, it is more reliably to let the adhesive A be less likely to attach to the other part of the bottom of the recess 45*x* than the protrusions 45*y*. By virtue of this, it is possible to form the damper chamber 45 in a desired size and to obtain a stable damper performance in a reliable manner.

The intervals S1 and S2 between the protrusion 45*y* and the side walls of the recess 45*x* are 1 mm or less (see FIG. 6). In this context, it is more reliably to let the adhesive A be less likely to attach to the other part of the bottom of the recess 45*x* than the protrusions 45*y*. By virtue of this, it is possible to form the damper chamber 45 in a desired size and to obtain a stable damper performance in a reliable manner.

The protrusions 45*y* are rectangular on the plane orthogonal to the direction Z (see FIG. 6). In this context, it is easy to let the intervals S1 and S2 be constant between the protrusions 45*y* and the side walls of the recess 45*x*, thereby allowing reliably for realizing the configuration of letting the adhesive A be less likely to attach to the other part of the bottom of the recess 45*x* than the protrusions 45*y*.

In the adhesive attaching process (FIG. 7A), the roller 90 is moved in a direction orthogonal to the direction X in which the protrusions 45*y* extend on the plane orthogonal to the direction Z (the transference direction T: see FIG. 6). In this context, in the contact part between the lower surface 13*x* of the damper plate 13 and the peripheral surface 90*x* of the roller 90, there is a smaller interval between the protrusion 45*y* and its peripheral part (another protrusion 45*y* or the side wall of the recess 45*x*). By virtue of this, it is more reliably to let the adhesive A be less likely to attach to the other part of the bottom of the recess 45*x* than the protrusions 45*y*. By virtue of this, it is possible to form the damper chamber 45 in a desired size and to obtain a stable damper performance in a more reliable manner.

Second Embodiment

Next, referring to FIG. 8, a head 1A according to a second embodiment of the present disclosure will be explained. Note that any explanation for the same configuration with the head 1 according to the first embodiment will be omitted.

With the head 1 in the first embodiment (FIG. 7B), the groove 12*y* is provided in the upper surface 12*x* of the spacer plate 12, such that the protrusion 45*y* of the damper plate 13 is not attached to the upper surface 12*x*. With the head 1A in the second embodiment (FIG. 8), however, the groove 12*y* is not provided in the upper surface 12*x* of the spacer plate 12, such that the protrusion 45$y$ of the damper plate 13 is attached to the upper surface 12$x$ via the adhesive A.

Note that as in the second embodiment, the configuration of the protrusion 45$y$ being attached to the upper surface 12$x$ is applicable to the case of, for example, the ink viscosity being 4 cps, and the drive frequency being 20 to 25 kHz.

According to the second embodiment, by attaching the protrusion 45$y$ to the upper surface 12$x$ of the spacer plate 12, it is possible to form the damper chamber 45 in a desired size and to obtain a stable damper performance.

Third Embodiment

Figure 9:
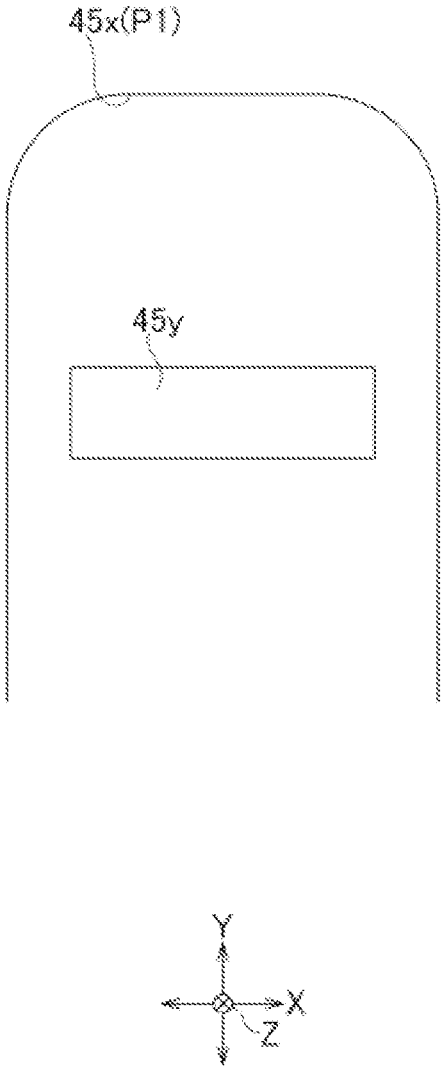
FIG. 9 is a plan view of a head 1B corresponding to FIG. 6.

Next, referring to FIG. 9, a head 1B according to a third embodiment of the present disclosure will be explained. Note that any explanation for the same configuration with the head 1 according to the first embodiment will be omitted.

With the head 1 in the first embodiment (FIG. 6), a plurality of protrusions 45$y$ are provided on bottom of the recess 45$x$ (the first part P1). With the head 1B in the third embodiment (FIG. 9), however, one protrusion 45$y$ is provided on the bottom of the recess 45$x$ (the first part P1). Further, in the third embodiment, in the same manner as in the second embodiment (FIG. 8), the groove 12$y$ is not provided in the upper surface 12$x$ of the spacer plate 12, such that the protrusion 45$y$ of the damper plate 13 is attached to the upper surface 12$x$ via the adhesive A.

Figure 8:
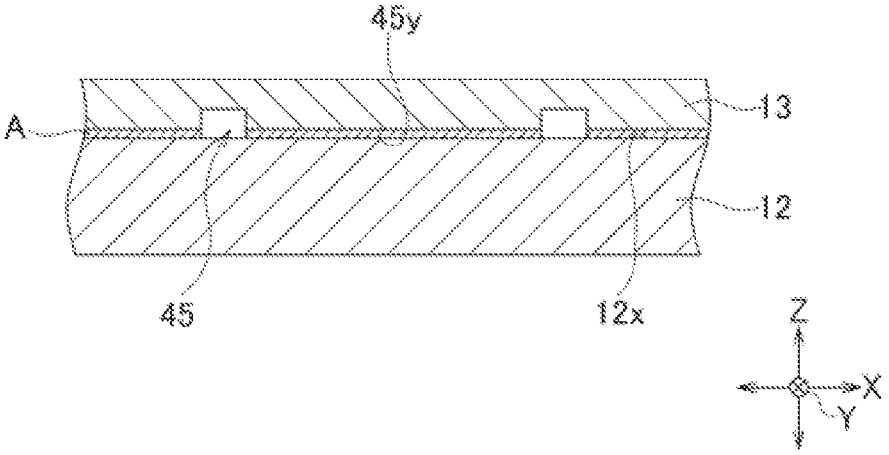
FIG. 8 is a cross section view of a head 1A corresponding to FIG. 7B.

According to the third embodiment, it is possible to apply the adhesive A reliably to the protrusion 45$y$ (see FIG. 8). In particular, if a plurality of protrusions 45$y$ are provided, then it is possible for the adhesive A to be unapplied to some of the plurality of protrusions 45$y$. As in the third embodiment, however, if one protrusion 45$y$ is provided, then it is possible to reliably apply the adhesive A to that protrusion 45$y$. Furthermore, it is possible to attach the protrusion 45$y$ to the upper surface 12$x$ of the spacer plate 12 and to obtain a stable damper performance in a more reliable manner.

Modified Embodiments

The embodiments of the present disclosure were explained hereinabove. However, the present disclosure is not limited to the above embodiments but may be changed and modified in various manners without departing from the true spirit and scope set forth in the appended claims.

The size and position of the protrusions may be determined by the elasticity of the roller peripheral part, the roller pressing force in the adhesive applying process, the necessary damper performance, and the like.

The protrusions are not limited to being rectangular on the plane orthogonal to the second direction, but may be trapezoidal, circular, or the like.

In the first embodiment (FIG. 6), the plurality of protrusions are arrayed in one direction (the direction Y). However, the plurality of protrusions may be arrayed in a matrix form in the second direction.

The leading end surface of the protrusion is not limited to being at the same level as the first surface of the first plate. For example, in the first embodiment (FIG. 5), the height of the protrusion 45$y$ is the same as the depth D1 of the recess 45$x$, and the leading end surface of the protrusion 45$y$ is at the same level as the lower surface 13$x$ of the damper plate 13. However, without being limited to that, the height of the protrusion 45$y$ may be smaller than the depth D1 of the recess 45$x$, and the leading end surface of the protrusion 45$y$ may be positioned above the lower surface 13$x$ of the damper plate 13 (closer to the bottom of the recess 45$x$).

The present disclosure is not limited to the application to printers but may be applied to facsimile apparatuses, photocopy apparatuses, multifunctional apparatuses, and the like. Further, the present disclosure is also applicable to liquid discharge apparatuses used for other purposes than recording images (such as liquid discharge apparatuses discharging an electrically conductive liquid to substrates to form an electrically conductive pattern). Further, the present disclosure is applicable to any apparatuses other than the liquid discharge apparatuses.

What is claimed is:

1. A liquid discharge head comprising:

a channel unit including:

a plurality of individual channels aligned in a first direction, each of the individual channels including a nozzle;

a common channel extending in the first direction and connected to the plurality of individual channels;

a supply hole connected to the common channel; and a damper chamber located at a position overlapping with the supply hole in a second direction orthogonal to the first direction, wherein the channel unit includes a first plate and a second plate, wherein the first plate includes a first surface which is orthogonal to the second direction and on which a recess forming the damper chamber is formed, wherein the second plate includes a second surface attached to the first surface via an adhesive, and wherein a protrusion is located at a bottom of a first part of the recess, the first part of the recess overlapping with the supply hole in the second direction.

2. The liquid discharge head according to claim 1, wherein the recess includes the first part, and a second part which is not overlapped with the supply hole and is overlapped with the common channel in the second direction, and wherein the first part of the recess is longer than the second part in a third direction orthogonal to the first direction and the second direction.

3. The liquid discharge head according to claim 1, wherein an inflow port of the supply hole is located at an end of the supply hole in the second direction, the end being opposite to the damper chamber in the second direction.

4. The liquid discharge head according to claim 1, wherein the second plate includes a groove arranged on the second surface and overlapped with the protrusion in the second direction.

5. The liquid discharge head according to claim 4, wherein the groove is deeper than the recess in the second direction.

6. The liquid discharge head according to claim 5, wherein the second plate is thicker than the first plate in the second direction.

7. The liquid discharge head according to claim 4, wherein the groove includes a first portion overlapping with the protrusion in the second direction, and a second portion overlapping with an area of the bottom other than the protrusion in the second direction.

8. The liquid discharge head according to claim 1, wherein the protrusion is attached to the second surface.

9. The liquid discharge head according to claim 8, wherein the protrusion is located on the bottom of the recess.

10. The liquid discharge head according to claim 1, wherein a plurality of protrusions including the protrusion are located on the bottom of the recess.

11. The liquid discharge head according to claim 1, wherein an interval between the protrusion and a side wall of the recess is 1 mm or less.

12. The liquid discharge head according to claim 1, wherein the protrusion is rectangular on a plane orthogonal to the second direction.

13. A method for manufacturing a liquid discharge head, the liquid discharge head comprising:

a channel unit including:

a plurality of individual channels aligned in a first direction, each of the individual channels including a nozzle;

a common channel extending in the first direction and connected to the plurality of individual channels;

a supply hole connected to the common channel; and a damper chamber located at a position overlapping with the supply hole in a second direction orthogonal to the first direction, wherein the channel unit includes a first plate and a second plate, wherein the first plate includes a first surface which is orthogonal to the second direction and on which a recess forming the damper chamber is formed, wherein the second plate includes a second surface attached to the first surface via an adhesive, and wherein a protrusion is located at a bottom of a first part of the recess, the first part of the recess overlapping with the supply hole in the second direction, the method for manufacturing the liquid discharge head comprising:

applying an adhesive to the first surface by applying the adhesive to a peripheral surface of an elastic roller and rotating the elastic roller while pressing the peripheral surface on the first surface; and attaching the second surface to the first surface via the adhesive by stacking the first plate and the second plate after applying the adhesive.

14. The method for manufacturing the liquid discharge head according to claim 13, wherein in applying the adhesive, the elastic roller is moved in a moving direction on a plane orthogonal to the second direction, the moving direction being orthogonal to a direction in which the protrusion extends.

* * * * *